US006294880B1

(12) United States Patent
Deurloo et al.

(10) Patent No.: US 6,294,880 B1
(45) Date of Patent: Sep. 25, 2001

(54) PROTECTION DEVICE IN A HID LAMP IGNITION CIRCUIT

(75) Inventors: Oscar J. Deurloo; Johannis A. A. Toonen, both of Eindhoven (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/483,599

(22) Filed: Jan. 14, 2000

(30) Foreign Application Priority Data

Jan. 18, 1999 (EP) ..... 99200132

(51) Int. Cl.[7] ..... H05B 37/02
(52) U.S. Cl. ..... 315/224; 315/307
(58) Field of Search ..... 315/307, 207, 315/209 R, 224, 225, 219, 291, 308, 247, 360

(56) References Cited

U.S. PATENT DOCUMENTS 5,463,287 * 10/1995 Kurihara et al. ..... 315/291
5,962,981 * 10/1999 Okude et al. ..... 315/224
6,013,988 * 1/2000 Bucks et al. ..... 315/307
6,049,179 * 4/2000 Kisaichi et al. ..... 315/224
6,081,439 * 6/2000 Kijima ..... 315/219

FOREIGN PATENT DOCUMENTS 2105125A 3/1983 (GB) ..... H05B/41/24
9739605A1 10/1997 (WO) ..... H05B/41/29
WO9739605 10/1997 (WO) ..... H05B/41/29

* cited by examiner

*Primary Examiner*—Don Wong
*Assistant Examiner*—Wilson Lee

(57) ABSTRACT

A circuit arrangement for igniting and operating a high-pressure discharge lamp includes input terminals for the connection of a supply source and output terminals for the connection of the lamp. A switching circuit operates the lamp at a nominal lamp voltage Vla during stable lamp operation and generates an open circuit voltage Vo at the output terminals before the lamp is ignited. A control circuit for controlling the switching circuit is provided with a device BM for limiting the voltage at the output terminals. A transition detection circuit M detects the transition from a glow discharge to an arc discharge.

21 Claims, 1 Drawing Sheet

PROTECTION DEVICE IN A HID LAMP IGNITION CIRCUIT

BACKGROUND OF THE INVENTION

This invention relates to a circuit arrangement for igniting and operating a high-pressure discharge lamp, provided with:

input terminals for the connection of a supply source, lamp-connection terminals for the connection of the lamp, switching means for operating the lamp at a nominal lamp voltage Vla during stable lamp operation, and for generating an open circuit voltage Vo on the lamp-connection terminals before the lamp is ignited, and a control circuit for controlling the switching means, and provided with means BM for limiting the voltage on the lamp-connection terminals.

A circuit arrangement of the type mentioned in the opening paragraph is known from WO 97/39605. The known circuit arrangement can suitably be used to operate and ignite, inter alia, high-pressure sodium lamps and metal-halide lamps. The means BM of the known circuit arrangement provide for a limitation of the voltage on the lamp-connection terminals after a predetermined time period to a value Vb, which is such that Vla<Vb<V0. In general, said lamps are provided with a discharge vessel wherein, during operation, an electric discharge is maintained, said discharge vessel being enclosed, with intervening space, by an outer bulb. Particularly metal-halide lamps have very good color properties and a high specific light output, so that said lamps can very suitably be used, inter alia, for interior lighting. When such a lamp reaches the end of its operational life, frequently leakage of the discharge vessel occurs. As a result of the generally very small dimensions of the lamp, said leakage may readily result in the formation of a discharge in the outer bulb, in particular during igniting the lamp. Such a discharge in the outer bulb may lead to such a substantial temperature increase of the lamp cap that there is a risk that the lighting unit wherein the lamp is mounted starts burning. Although, in the case of the known circuit arrangement, the means BM will reduce the voltage on the lamp-connection terminals to the value Vb after the predetermined time has elapsed, so that in general any discharge formed in the outer bulb will be extinguished, but this proves insufficient to ward off the risk that the lighting unit starts burning. This is a drawback. cl SUMMARY OF THE INVENTION It is an object of the invention to obviate the above-described drawback.

In accordance with the invention, this object is achieved in that a circuit arrangement of the type mentioned in the opening paragraph is characterized, as a circuit arrangement in accordance with the invention, in that the circuit arrangement is provided with means M for detection of a transition from a glow discharge to an arc discharge. A transition from a glow discharge to an arc discharge is always accompanied by a current peak. On the one hand, such a current peak leads to a substantial dissipation, on the other hand, the occurrence of a current peak is a phenomenon which can be detected relatively easily. When a discharge lamp is ignited, the following phases can be distinguished:

extinguished state wherein no current flows through the lamp; the voltage across the lamp is equal to the voltage which is generated as the open voltage Vo by the circuit arrangement; as a result of an applied voltage pulse, breakdown takes place; a glow discharge is formed in the lamp which is accompanied by a very small current through the lamp and a relatively high voltage across the lamp;

transition to an arc discharge; this transition is accompanied by an abrupt decrease of the voltage across the lamp and a corresponding current peak through the lamp. Subsequently, as a result of a gradual increase of the voltage across the lamp to the nominal lamp voltage Vla, the stable operating condition of the lamp occurs.

In lamps used in practice, the voltage level across the lamp during glow discharge is of the order of 200 V or more. The transition to the arc discharge is accompanied by an abrupt decrease to a level ranging from 20 V to 100 V, so that a current peak occurs. When a discharge takes place in the outer bulb of the lamp, a similar succession of events takes place. In this case, the transition from glow discharge to arc discharge is accompanied by a current peak of the order of 20 to 25 A. In general, the discharge in the outer bulb is extinguished after the current peak, whereafter a repetition of events takes place.

In an advantageous embodiment, the means M generate a signal S upon detection of the transition. Preferably, the means BM can suitably be used to limit the voltage on the lamp-connection terminals in dependence upon the signal S. In a very suitable embodiment, the means BM comprise a counting register for counting and registering the detected transitions. For this purpose, the means BM preferably comprise a timer. In a favorable embodiment wherein limitation of the voltage at the lamp-connection terminals takes place after a time period, which is set and measured by the timer, has elapsed, the signal S provides for accelerated counting by the timer. As a result, the occurrence of an arc discharge in the outer bulb of the lamp will lead to an accelerated reduction of the voltage at the lamp-connection terminals. It has been found that limitation of the voltage at the lamp-connection terminals to a value Vb such that no discharge can take place in the lamp, is sufficient to also preclude breakdown in the outer bulb. In another embodiment, switching-off of the circuit arrangement takes place.

BRIEF DESCRIPTION OF THE DRAWINGS

The above-described and further aspects of the invention will be apparent from and elucidated with reference to a drawing of an embodiment of the circuit arrangement in accordance with the invention.

In the drawings.

DESCRIPTION OF THE PREFERRED EMBODIMENTS

Figure 1:
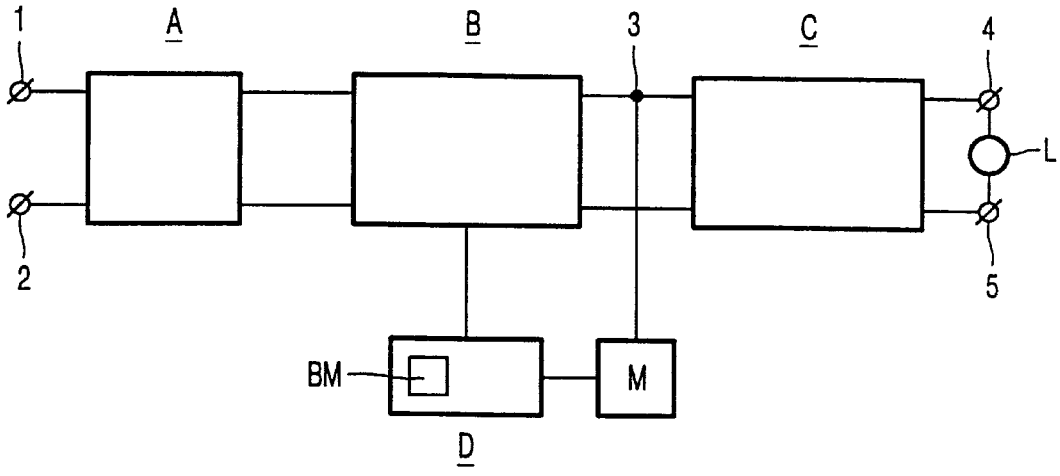
FIG. 1 is a circuit diagram of a circuit arrangement in accordance with the invention.

In FIG. 1, reference numerals 1, 2 refer to input terminals of a circuit arrangement in accordance with the invention, which can suitably be used for connecting a supply source, for example 230 V, 50 Hz. Reference label A indicates means with which the applied supply voltage is converted to a stabilized direct voltage, for example, 400 V. In a practical embodiment, the means A comprise a rectifier bridge and a preconditioner in the form of a (step) up-converter or boost converter. Means B form a switching supply (SMPS), for example in the form of a buck converter or down-converter. The SMPS serves as a controllable current source (controlled constant current generator) for a commutator circuit C, for example, a bridge circuit. The circuit C also comprises ignition means for generating ignition voltage pulses for igniting a discharge lamp L connected to lamp-connection terminals 4, 5. Means B form switching means for operating the lamp at a nominal lamp voltage Vla during stable lamp operation and for generating an open circuit voltage Vo on the lamp-connection terminals prior to ignition of the lamp. A control circuit D controls the circuit means, and is provided with means BM for limiting the voltage on the lamp-connection terminals. Control circuit D also comprises means M for detecting a transition from a glow discharge to an arc discharge.

Figure 2:
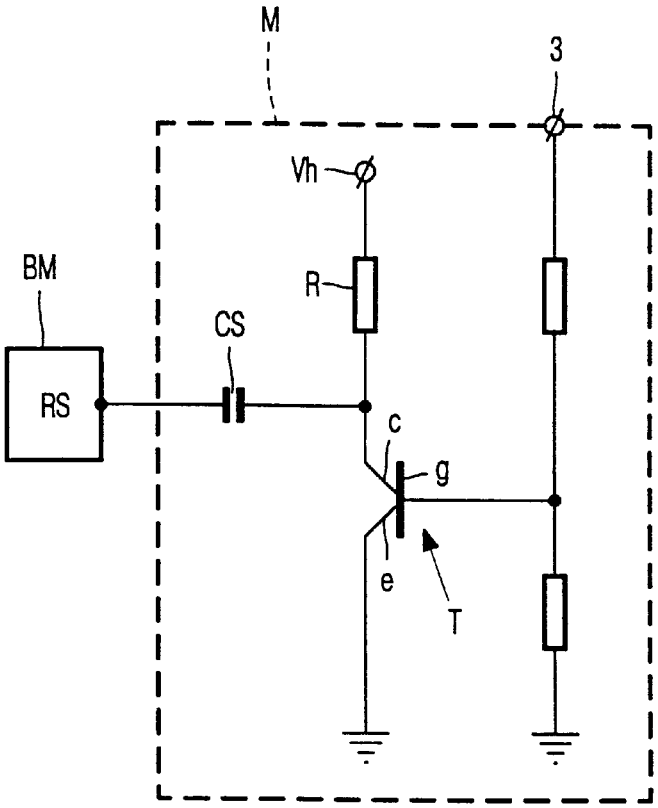
FIG. 2 is a detailed view of a timer circuit of the circuit arrangement shown in FIG. 1.

In FIG. 2, the means M are shown in greater detail. A switch T, for example a transistor, is connected with a control electrode g to a voltage-dividing chain which is connected to a terminal 3 in the connection between the SMPS B and the commutator C. An emitter-electrode e of switch T is grounded and a collector c is connected by means of a resistor R to an auxiliary voltage Vh. The collector c is also connected, via a separating capacitor Cs, to a reset pin RS of a timer-ic which forms a art of the means BM of the control circuit D. The capacitor Cs also forms a differentiator, as a result of which it is achieved that only an abrupt change of the voltage on the terminal 3 causes a signal to be applied to the RS pin of the ic. A transition from glow discharge to arc discharge, detected at the terminal 3, causes a signal S to be applied, by means of switch T, to the reset pin RS of the timer-ic. In a practical embodiment of the switching device, the timer-ic is of the HEF4541-type, which is produced by Philips. The switch T was formed by a bipolar transistor of the BC847C-type, manufactured by Philips. The auxiliary voltage Vh has a value of 10 V. A transition from the glow discharge to the arc discharge is accompanied by a sudden, large voltage drop across the discharge. As a result, the switch T, which was initially in the conducting state, is switched to a non-conducting state. As a result, a voltage pulse is generated at the collector which is supplied as a signal S to the reset pin RS. As a result counting of the timer of the timer-ic is extra increased by one.

The circuit arrangement described hereinabove is used to ignite and operate a metal-halide lamp of the CDM70W-type, manufactured by Philips, having a nominal rating of 70 W.

What is claimed is:

1. A circuit arrangement for igniting and operating a high-pressure discharge lamp, comprising:

input terminals for the connection of a supply source, lamp-connection terminals for the connection of the lamp, switching means for operating the lamp at a nominal lamp voltage Vla during stable lamp operation, and for generating an open voltage Vo on the lamp-connection terminals before the lamp is ignited, a control circuit for controlling the switching means, and provided with means BM for limiting the voltage on the lamp-connection terminals, and means M for detection of a transition from a glow discharge to an arc discharge.

2. A circuit arrangement as claimed in claim 1, characterized in that the means M generate a signal S upon detection of the transition.

3. A circuit arrangement as claimed in claim 2, characterized in that the means BM limits the voltage on the lamp-connection terminals in dependence upon the signal S.

4. A circuit arrangement as claimed in claim 2, wherein the means BM comprise a counting register for counting and registering the detected transitions.

5. A circuit arrangement as claimed in claim 4, wherein the means BM comprise a timer.

6. A circuit arrangement as claimed in claim 5, wherein limiting of the voltage at the lamp-connection terminals takes place after a time period, has elapsed which is set and measured by the timer, and the signal S provides for accelerated counting by the timer.

7. A circuit arrangement as claimed in claim 1, wherein the means BM comprise a counting register for counting and registering the detected transitions.

8. A circuit arrangement as claimed in claim 7, wherein the means BM comprise a timer.

9. A circuit arrangement as claimed in claim 3, wherein the means BM comprise a counting register for counting and registering the detected transitions.

10. A circuit arrangement as claimed in claim 9, wherein the means BM comprise a timer.

11. A circuit arrangement as claimed in claim 3, wherein the means BM comprise a timer.

12. A circuit arrangement as claimed in claim 11, wherein limiting of the voltage at the lamp-connection terminals takes place after a time period has elapsed which is set and measured by the timer, and the signal S provides for accelerated counting by the timer.

13. A circuit arrangement as claimed in claim 2, wherein the means BM comprise a timer.

14. A circuit arrangement as claimed in claim 13, wherein limiting of the voltage at the lamp-connection terminals takes place after a time period has elapsed which is set and measured by the timer, and the signal S provides for accelerated counting by the timer.

15. A circuit for igniting and operating a high pressure discharge lamp comprising:

input terminals for connection to a source of supply voltage for the circuit, output terminals for connection to the discharge lamp, a switching circuit coupled to the input terminals and to the output terminals for supplying a nominal lamp operating voltage (Vla) during stable operation of a connected discharge lamp, and for generating an open circuit ignition voltage (Vo) at the output terminals prior to ignition of a connected discharge lamp, a control circuit for controlling operation of the switching circuit and including means (BM) for limiting the voltage at the output terminals, and detection means coupled to the control circuit for detection of a transition from a glow discharge to an arc discharge within a connected discharge lamp.

16. The igniting and operating circuit of claim 15 wherein the voltage limiting means is responsive to a signal (S) from the detection means at the instant of detection of said glow discharge to arc discharge transition to limit the voltage at the output terminals.

17. The igniting and operating circuit of claim 15 wherein the detection means is operative during the ignition phase of a connected discharge lamp to generate a detection signal (S) for control of the voltage limiting means dependent upon the detection of said glow discharge to arc discharge transition, whereupon the voltage limiting means limits the voltage at the output terminals.

18. The igniting and operating circuit of claim 17 wherein, in response to the detection signal (S), the voltage limiting means limits the voltage at the output terminals to a voltage of a value (Vb) such that a discharge cannot take place in a connected discharge lamp.

19. The igniting and operating circuit of claim 15 wherein the detection means detects a sudden increase in current to a connected discharge lamp which occurs upon said transition of said glow discharge to said arc discharge.

20. The igniting and operating circuit of claim 15 wherein the detection means detects a sudden drop in voltage of a connected discharge lamp which occurs upon said transition of said glow discharge to said arc discharge.

21. The igniting and operating circuit of claim 15 wherein, upon detection by the detection means of said glow discharge to arc discharge transition, the voltage limiting means limits the voltage at the output terminals to a value (Vb) such that Vla<Vb<Vi, where Vi is the discharge lamp ignition voltage.

* * * * *